US007667601B2

(12) United States Patent
Rabinowitz et al.

(10) Patent No.: US 7,667,601 B2
(45) Date of Patent: Feb. 23, 2010

(54) APPARATUS FOR SECURE DISPLAY, INTERACTIVE DELIVERY OF PRODUCT INFORMATION AND CHARGING OF BATTERY-OPERATED HAND HELD ELECTRONIC DEVICES

(75) Inventors: Alan Rabinowitz, Freehold, NJ (US); Richard Ryczek, Butler, NJ (US)

(73) Assignee: Vira Manufacturing, Inc., Perth Amboy, NJ (US)

( * ) Notice: Subject to any disclaimer, the term of this patent is extended or adjusted under 35 U.S.C. 154(b) by 418 days.

(21) Appl. No.: 11/708,243

(22) Filed: Feb. 20, 2007

(65) Prior Publication Data

US 2007/0194918 A1 Aug. 23, 2007

Related U.S. Application Data

(60) Provisional application No. 60/775,935, filed on Feb. 23, 2006.

(51) Int. Cl.
*G08B 13/14* (2006.01)

(52) U.S. Cl. ..... 340/568.2; 340/539.1; 340/691.6

(58) Field of Classification Search ... 340/568.2–568.4, 340/572.1, 691.1, 691.5, 691.6, 687, 693.1, 340/693.2, 693.4, 539.1
See application file for complete search history.

(56) References Cited

U.S. PATENT DOCUMENTS 5,151,684 A * 9/1992 Johnsen ..... 340/568.2
5,246,183 A 9/1993 Leyden
5,552,771 A 9/1996 Leyden et al.
5,555,302 A 9/1996 Wang
5,608,449 A * 3/1997 Swafford et al. ..... 725/74
5,903,645 A 5/1999 Tsay
6,002,921 A 12/1999 Pfahlert et al.
6,386,906 B1 * 5/2002 Burke ..... 439/501
6,476,717 B1 11/2002 Gross et al.
6,659,382 B2 12/2003 Ryczek
6,756,900 B2 6/2004 Leyden et al.
6,903,656 B1 * 6/2005 Lee ..... 340/572.1
6,946,961 B2 9/2005 Frederiksen et al.
7,015,596 B2 * 3/2006 Pail ..... 307/28
7,053,774 B2 5/2006 Sedon et al.
7,209,038 B1 * 4/2007 Deconinck et al. ..... 340/568.2
7,403,119 B2 * 7/2008 Leyden ..... 340/568.2
2005/0040949 A1 2/2005 Frederiksen et al.
2006/0208921 A1 9/2006 Ott

* cited by examiner

*Primary Examiner*—Thomas J Mullen
(74) *Attorney, Agent, or Firm*—Robert L. Epstein; Epstein Drangel Bazerman & James, LLP

(57) ABSTRACT

Security apparatus is provided for the display of battery operated hand-held electronic devices. It includes a electronic recoiler device that combines the function of tethering the displayed devices while at the same time providing the power required by each of the displayed devices by means of a continuous electrical connection from a power supply to each displayed device. It also provides wire and wireless alarm functions, as well as visual perpetrator identification. The apparatus also provides specific product information and comparative product information to the potential customer by visual and audible means.

51 Claims, 11 Drawing Sheets

APPARATUS FOR SECURE DISPLAY, INTERACTIVE DELIVERY OF PRODUCT INFORMATION AND CHARGING OF BATTERY-OPERATED HAND HELD ELECTRONIC DEVICES

CROSS-REFERENCE TO RELATED APPLICATIONS

This application claims the priority of U.S. Provisional Application Ser. No. 60/775,935, filed Feb. 23, 2006.

STATEMENT REGARDING FEDERALLY SPONSORED RESEARCH OR DEVELOPMENT

Not Applicable

REFERENCE TO A "SEQUENCE LISTING", A TABLE, OR A COMPUTER PROGRAM LISTING APPENDIX SUBMITTED ON COMPACT DISC

Not Applicable

BACKGROUND OF THE INVENTION

1. Field of the Invention

The present invention relates to an apparatus for securely displaying, marketing and recharging battery operated, hand-held electronic devices. In particular, the present invention relates to a display apparatus that interactively delivers product information about a device selected by a potential customer from the display, collects and transmits marketing information about the selected device, while allowing the potential customer to hold the device at a limited distance from a display which automatically retracts and correctly positions the hand-held device on the display after its release, and more particularly, to such a display apparatus that is capable of charging the battery of the device while at the same time protecting the device against pilferage with wired and wireless alarms controlled by the display apparatus.

2. Description of Prior Art Including Information Disclosed Under 37 CFR 1.97 and 1.98

With the growth of electronic devices in general, and the ability to miniaturize such devices in particular, light weight, battery operated, hand-held devices have become pervasive. Such devices include mobile phones, digital cameras, global positioning systems and hand-held computers, as well as music recording/playback units, and are sold to the public in a wide range of retail stores.

To properly market such devices, research indicates that consumers need to assure themselves that the device can be used comfortably and easily manipulated in the hands of the prospective consumer. In other words, the consumer must be free to hold and handle the device to make sure it is suitable. However, by allowing a consumer to inspect the item in that manner, the retailer is subjected to the possibility of substantial loss through theft and other forms of shrinkage and breakage. Currently, the shrinkage of small portable electronic devices is estimated to be as much as about 20%.

It is also important for the marketing of such devices that the devices be displayed in the proper orientation, that is, the devices must always be presented to the potential consumer in an upright position. That requirement is successfully dealt with in U.S. Pat. No. 6,659,382, entitled "Security Device For Display of Hand Held Items" issued to Richard Ryczek on Dec. 9, 2003 and owned by the assignee of the present application, which is herein incorporated by reference in its entirety.

In the apparatus described in that patent, the displayed device is attached to a support by a tether such that it can be moved away from the support and held by the potential consumer. A positioning system is provided so that when the hand-held device is retracted, the male component of the clamp that engages the device can be received in the female component on the support in only a single relative orientation. That or a similar positioning system may be used with the present invention, as explained below.

Various attempts have been made to make retail displays which allow manipulation of displayed devices while attempting to prevent theft. For example, U.S. Pat. No. 5,246,183 issued on Sep. 21, 1993 to Leyden discloses a tethering device for use in locations such as motel rooms that allows a remote control to be used but prevents its removal from the room. A spring in combination with a spool and cable allows a user to pull the hand-held remote control from a fixed position and automatically returns the hand-held remote control back to its original location. However, the Lyden apparatus is not a display device for marketing. It does not guide the displayed item after release into a desired upright display position.

While there have been a number of holders for hand-held telephones, hand-held computers and the like, they have been designed to facilitate carrying and using the device rather than for security in display and marketing. Prior to the device disclosed in the aforementioned Ryczek patent, there was no apparatus designed for securing a mobile phone on a display. There were, however, various devices that achieve the reverse. Such devices come with a variety of quick release mechanisms. See for example U.S. Pat. No. 5,903,645 issued on May 11, 1999 to Tsay and U.S. Pat. No. 5,555,302 issued on Sep. 10, 1996 to Wang.

U.S. Pat. No. 6,002,921 issued on Dec. 14, 1999 to Pfahlert discloses a lockable cradle for holding a radiotelephone for use in vehicles that is released by a radio signal. That vehicle mounted apparatus must be of a special construction and size to mate with the security system having grooves. Moreover, that apparatus is not designed for use in display systems, with existing devices, nor does it include a retracting and positioning system of the present invention.

The apparatus disclosed in the aforementioned Ryczek patent was the first apparatus of its type to fulfill the above noted requirements. The apparatus disclosed in that patent was designed specifically for displaying mobile phones and other hand-held devices. It includes three major components: a clamping system, a retracting system and the positioning system briefly described above.

The clamping system consists of two parts which are fastened together around a fitting attached to the end of a cord. The fitting has a hole drilled through it to allow such a fastening. A single security screw or bolt holds the two parts together with a key required to turn the head of the bolt or screw. The clamping system is locked onto the fitting and cannot be removed without the proper key. The clamping system has a lip on two opposite sides which prevents a person from removing the hand held device when the clamping system is fastened to the fitting and the hand held device is within the lips of the clamping system and attaches to a cable with a device also having a positioning guide to assure proper orientation of the hand-held device on display.

The retracting system includes a coil spring, a spool and a cord mounted in a common decorative support on which the displayed device rests. One end of the coil spring connects to the spool and the other end is attached to the support. The cord is wrapped around the spool with one end attached to the spool and the other end attached to the mobile phone. When the displayed device is removed from the support, the spool is turned and the coil spring is placed in tension. When the displayed device is released, the coil spring returns the spool to its original position.

The positioning system is provided to bring the displayed device back to its desired display position. The cord attached to the spool and the displayed device is made from a relatively stiff material such as braided steel wire or cable. Thus, if the cord is pulled from the display unit and the displayed device is twisted or turned, the cord will develop a counter force to return the displayed device, upon release, to the original, upright position.

To guide the device back into the proper position, the cord has on the end that emerges from the support a first half of a positioning system which connects to the clamping system. The positioning system comprises interlocking or complementary male and female fittings. The fitting attached to the end of the cord may be either male or female with a corresponding mating fitting mounted on the support. The cross-section of the male-female fitting pair may be of any shape other than circular with ovoid shapes preferred and cross-sectional ovoid shapes having guiding ribs contained within the ovoid female cross-section or on the exterior of the male ovoid cross-section most preferred. A non-circular shape, such as an ovoid, along with the ribs will assure that when the male fitting enters its female counterpart, the orientation of the fitting at the end of the cord will be the same as when the fitting, clamping system, or any device held within the clamping system, was pulled. The ribs assist with the guidance of the male fitting into the female fitting and assure that the fitting will return to its intended display orientation. Thus, the security display apparatus of the patent meets the needs of consumers and merchants by enabling a potential purchaser to conveniently examine a hand-held device while preventing its theft and guaranteeing its return to a suitable display position when released after examination.

The aforementioned display apparatus of the Ryczek patent does not address the issue of providing an alarm to alert store and security personnel if a displayed electronic device is removed from the clamping device or if the tether connecting the electronic device to the display apparatus is cut or if the electronic device is removed from the store or display area. Nor does it address the issue of providing an audible alarm if a displayed electronic device is tampered with by removal of the power plug from the device or removal of the device itself from the means used to secure it to the security tether or if the electronic device is removed from the store or display area. It does not have the capability of wirelessly transmitting an alarm signal to security personnel at a location remote from the display or of displaying a visual alert on a video display that forms part of the display apparatus. All of the above are addressed by the apparatus of the instant invention.

In addition, the Rycek display apparatus does not provide a means of interactively providing product information relating to a particular device of interest to a potential customer or of interactively providing information for training sales personnel, as is provided by the apparatus of the instant invention.

Due to the high rate of shrinkage of hand-held consumer electronics stocks, there is a need not only to deter pilferage of such items on display by tethering and clamping the device but also for alerting store and security personnel by alarm and visual means if the device is removed from the clamp, or if the tether or power supply cord are severed.

Because the areas in which such hand-held consumer electronic devices are displayed are often crowded there is also a need to visually identify the perpetrator of a theft or attempted theft of the displayed devices.

Because of the manifold features of the many models and brands of hand-held consumer electronic devices such as cellular phones, digital cameras, global positioning systems and hand-held computers, as well as music recording/playback units, there is a need to conveniently, effectively and interactively provide product information and comparisons about a device selected by a potential customer from the display apparatus.

There is, in addition, a need to interactively train sales personnel on the features and comparative features of the many models and brands of handheld consumer electronic devices such as cellular phones, digital cameras, global positioning systems and hand-held computers, as well as music recording/playback units.

There is a further need to immediately obtain information on customer preferences, for use in marketing these devices, for any one or all of the displayed handheld consumer electronic devices.

BRIEF DESCRIPTION OF THE INVENTION

It is a prime object of the present invention to provide a display apparatus for securely displaying, marketing and continuously recharging battery operated hand-held electronic devices that can interactively deliver product information about a device selected by a potential customer from the display.

It is another object of the present invention to provide a display device that collects and transmits marketing information about the device selected by the consumer.

It is another object of the present invention to provide a display device which allows the potential customer to hold and handle the device while, at the same time, preventing theft of the device.

It is another object of the present invention to provide a display device that permits the consumer to remove the device from the display apparatus and hold it at a limited distance from the display apparatus.

It is another object of the present invention to provide a display device that, after release of the device, automatically retracts and correctly positions the hand-held device on the display apparatus.

It is another object of the present invention to provide a display apparatus that is capable of charging the battery of the battery operated device such that the device is always fully charged.

It is another object of the present invention to provide a display apparatus that protects the device against pilferage by providing wired and wireless alarms controlled by the display apparatus to alert store and security personnel if a displayed electronic device is removed from the clamping device.

It is another object of the present invention to provide a display apparatus that sends out an alarm if the tether connecting the electronic device to the display apparatus is cut.

It is another object of the present invention to provide a display apparatus that sends out an alarm if the electronic device is removed from the store or display area.

It is another object of the present invention to provide a display apparatus that interactively provides product information relating to a particular device of interest to a potential customer or for training sales personnel.

It is another objective of the present invention to provide a display apparatus that not only deters pilferage of devices on display by tethering and clamping means but also alerts store and security personnel by audible and visual means if the device is removed from the clamp or if the tether or power supply cord are severed.

It is a still further objective of the present invention to provide a display apparatus that provides means to visually identify the perpetrator of a theft or attempted theft of the displayed device.

It is another object of the present invention to provide a display apparatus that conveniently, effectively and interactively provides product information and comparisons about a device selected by a potential customer from the display apparatus.

It is another object of the present invention to provide a display apparatus that can interactively train sales personnel on the features of the displayed devices and the comparative features of the many models and brands of hand-held consumer electronic devices such as cellular phones, digital cameras, global positioning systems and hand-held computers, as well as music recording/playback units.

It is another object of the present invention is to provide a display apparatus that can immediately obtain information on customer preferences, for use in marketing the displayed devices, for any one or all of the hand-held consumer electronic devices displayed thereon.

In general, those objects are achieved by the display apparatus of the present invention as follows.

In accordance with one aspect of the present invention, display apparatus for a battery operated, hand-held, electronic device is provided. The apparatus includes a support, means for engaging the device, a spring-loaded recoiler situated in the support, and a tether having one end attached to the device engaging means and a second end attached to the recoiler. The recoiler normally causes the tether to urge the device towards a given position relative to the support. An alarm is provided, as are means for sensing the cutting of the tether and for energizing the alarm in response thereto. Also included are video display means and means for actuating the video display means in response to the movement of the device away from its given position relative to the support.

The apparatus further includes a flash media player associated with the video display means.

The apparatus further includes speaker means associated with the display means.

The apparatus further includes indicator means and means for energizing the indicator means. The means for energizing the indicator means is operably connected to the sensing means and is energized thereby in response to the cutting of the tether.

The apparatus further includes a second spring-loaded recoiler and a second tether having one end attached to the device engaging means and a second end attached to the second recoiler.

The sensing means preferably senses the cutting of one or both of the tethers.

The apparatus further includes wireless signaling means actuated by the sensing means for sending a signal to a remote location indicating the cutting of the tether.

The apparatus further includes means for selecting a message corresponding to the displayed device for display on the video display means.

The apparatus further includes means for charging the battery of the displayed device.

In accordance with another aspect of the present invention, display apparatus for first and second battery operated, hand-held, electronic devices is provided. The apparatus includes a support, and associated with each of the displayed devices: means for engaging the device, a spring-loaded recoiler situated in the support, a tether having one end attached to the device engaging means for that device and a second end attached to the recoiler. The recoiler normally causes the tether to urge the device towards a given position relative to the support. An alarm is provided, along with means for sensing the cutting of the tether and for energizing the alarm in response thereto. Also provided are video display means and means for actuating the video display means to display a message associated with a device, in response to the movement of that device away from its given position relative to the support.

The apparatus further includes a flash media player associated with the video display means.

The apparatus further includes speaker means associated with the display means.

The apparatus further includes indicator means and means for energizing the indicator means. The means for energizing the indicator means is operably connected to the sensing means and is energized thereby in response to the cutting of the tether.

The apparatus further includes a second spring-loaded recoiler and a second tether for each displayed device, the second tether having one end attached to the device engaging means for that device and a second end attached to the second recoiler.

The sensing means preferably senses the cutting of one or both of the tethers.

The apparatus further includes wireless signaling means actuated by the sensing means for sending a signal to a remote location indicating the cutting of the tether.

The apparatus further includes means for selecting a message corresponding to the displayed device for display on the video display means.

The apparatus further includes means for charging the battery of the displayed device.

The apparatus further includes counter means associated with the tether attached to each displayed device and means for actuating each of the counter means in response to the movement of the device attached to the tether associated with that counter means.

The apparatus further includes means for selecting a message for display on the video display means in accordance with the displayed device that is moved from its given position relative to the support. Preferably, a different message is associated with each displayed device.

In accordance with another aspect of the present invention, display apparatus for a battery operated, hand-held, electronic device is provided. The apparatus includes a support, means for engaging the device, a spring-loaded recoiler situated in the support, and a tether having one end attached to the device engaging means and a second end attached to the recoiler. The recoiler normally causes the tether to urge the device towards a given position relative to the support. Camera means are provided. Sensing means are provided for sensing the cutting of the tether and for actuating the camera means in response thereto. Video display means are included, as are means for actuating the video display means in response to the movement of the device away from its given position relative to the support.

The apparatus further includes audible alarm means and means for sensing the cutting of the tether and for actuating the audible alarm means in response thereto.

The apparatus further includes a second spring-loaded recoiler and a second tether having one end attached to the device engaging means and a second end attached to the second recoiler.

The sensing means senses the cutting of one or both of the tethers.

The apparatus further includes wireless signaling means actuated by the sensing means for sending a signal to a remote location indicating the cutting of the tether.

The apparatus is situated in a room with an exit. Means are associated with the device for actuating an alarm when the device passes through the exit.

The apparatus further includes means for selecting a message for display on the video display means.

The apparatus further includes means for charging the battery of the device.

The device further includes counter means and means for actuating the counter means in response to the movement of the device from its given position relative to the support.

The apparatus further includes a second device normally situated in a given position relative to the support and means for actuating the video display means in response to the movement of the second device from its given position relative to the support.

In accordance with another aspect of the present invention, a display apparatus is provided for a battery operated, hand-held electronic device. The apparatus includes a support, means for engaging the device, a spring-loaded recoiler situated in the support, a tether, one end of the tether being attached to the device engaging means and a second end attached to the recoiler. The recoiler normally causes the tether to urge the device towards a given position relative to the support. Counter means are provided as are means for actuating the counter means in response to the movement of the device away from its given position relative to the support.

The apparatus further includes an alarm and means for sensing the cutting of the tether and for energizing the alarm in response thereto.

The apparatus further includes video display means and means for actuating the video display means in response to the movement of the device away from its given position relative to the support.

The apparatus further includes a flash media player associated with the video display means.

The apparatus further includes speaker means associated with the display means.

The apparatus further includes indicator means and means for energizing the indicator means. The means for energizing the indicator means is operably connected to the sensing means and is energized thereby in response to the cutting of the tether.

The apparatus further includes a second spring-loaded recoiler and a second tether having one end attached to the device engaging means and a second end attached to the second recoiler.

The sensing means preferably senses the cutting of one or both of the tethers.

The apparatus further includes wireless signaling means actuated by the sensing means for sending a signal to a remote location indicating the cutting of the tether.

The apparatus further includes means for selecting a message corresponding to the displayed device for display on the video display means.

The apparatus further includes means for charging the battery of the displayed device.

In accordance with another aspect of the present invention, a display apparatus is provided for a battery operated, hand-held, electronic device. The apparatus includes a support, means for engaging the device, a spring-loaded recoiler situated in the support, an electrically conductive tether, one end of the tether being attached to the device engaging means and a second end attached to the recoiler. The recoiler normally causes the tether to urge the device towards a given position relative to the support. The device engaging means contains power management means, means to output power to maintain the battery in the displayed device in a charged condition, power output sensing means and alarm signal transmission means. The apparatus also includes means associated with the recoiler for sensing the cutting of the tether, for receiving an alarm signal from the alarm transmission means and for energizing the alarm means in response thereto. The device also includes power output means associated with the recoiler wherein power is transmitted through the tether to the power management means contained in the device engaging means.

The apparatus further includes camera means, means for actuating the camera means and for transmitting a pixilated image from the camera means to a remote monitor.

The apparatus further includes means for preventing the transmission of DC power of inappropriate polarity to means associated with the recoiler.

In accordance with another aspect of the present invention, display apparatus is provided for a battery operated, hand-held, electronic device, the device being of the type being powered by at least one battery. The apparatus includes a support, means for engaging the device, means for providing power to maintain the at least one battery of the device in a charged condition, power level sensing means for detecting a change in the level of power provided by the power providing means and alarm signal transmission means responsive to the power level sensing means for generating an alarm signal when a change in the power level is sensed.

The apparatus also includes a spring-loaded recoiler with two separate electrically conductive springs and a tether having two electrically conductive strands. One end of the tether is attached to the device engaging means with the electrically conductive strands of the tether electrically connected to the power level sensing means. The second end of the tether is attached to the recoiler, with each electrically conductive strand connected to a separate one of the electrically conductive springs of the recoiler.

The power level sensing means senses the cutting of at least one of the electrically conductive strands of the tether and generates an alarm signal in response thereto.

The power providing means normally provides DC power having appropriate polarity to the device. The DC power is transmitted through the springs of the recoiler and through the electrically conductive strands of the tether to the device.

The apparatus further includes means for preventing transmission of DC power of inappropriate polarity to the recoiler.

The apparatus also has video display means and means for actuating the video display means in response to the movement of the device relative to the support. A flash media player associated with the video display means.

The apparatus also includes speaker means associated with the video display means.

The apparatus also includes indicator means. The indicator means is operably connected to the power level sensing means and is activated thereby in response to the cutting of at least one of the electrically conductive strands of the tether.

The apparatus further includes counter means associated with the recoiler and means for actuating the counter means in response to the movement of the device attached to the tether associated with the recoiler.

The apparatus further includes wireless signaling means actuated by the power level sensing means for sending a signal to a remote location indicating the cutting of at least one of the electrically conductive strands of the tether.

The apparatus may be used with a second battery operated, hand-held, electronic device. It includes video display means and means for selecting a message for display on the video display means. A different message is associated with each device.

The apparatus further includes camera means and means for actuating the camera means and for transmitting a pixilated image from the camera means to a remote monitor, in response to the power level sensing means sensing the cutting of at least one of the electrically conductive strands of the tether.

BRIEF DESCRIPTION OF THE SEVERAL VIEWS OF DRAWINGS

To these and to such other objects that may hereinafter appear, the present invention relates to security apparatus for the commercial display and charging of battery powered, hand-held electronic devices, the alarming of such devices against pilferage, and the transmission of information about such devices in a commercial sales setting, as described in detail in the following specification and recited in the annexed claims, taken together with the accompanying drawings, in which like numerals refer to like parts and in which:

DETAILED DESCRIPTION OF THE INVENTION

Figure 1:
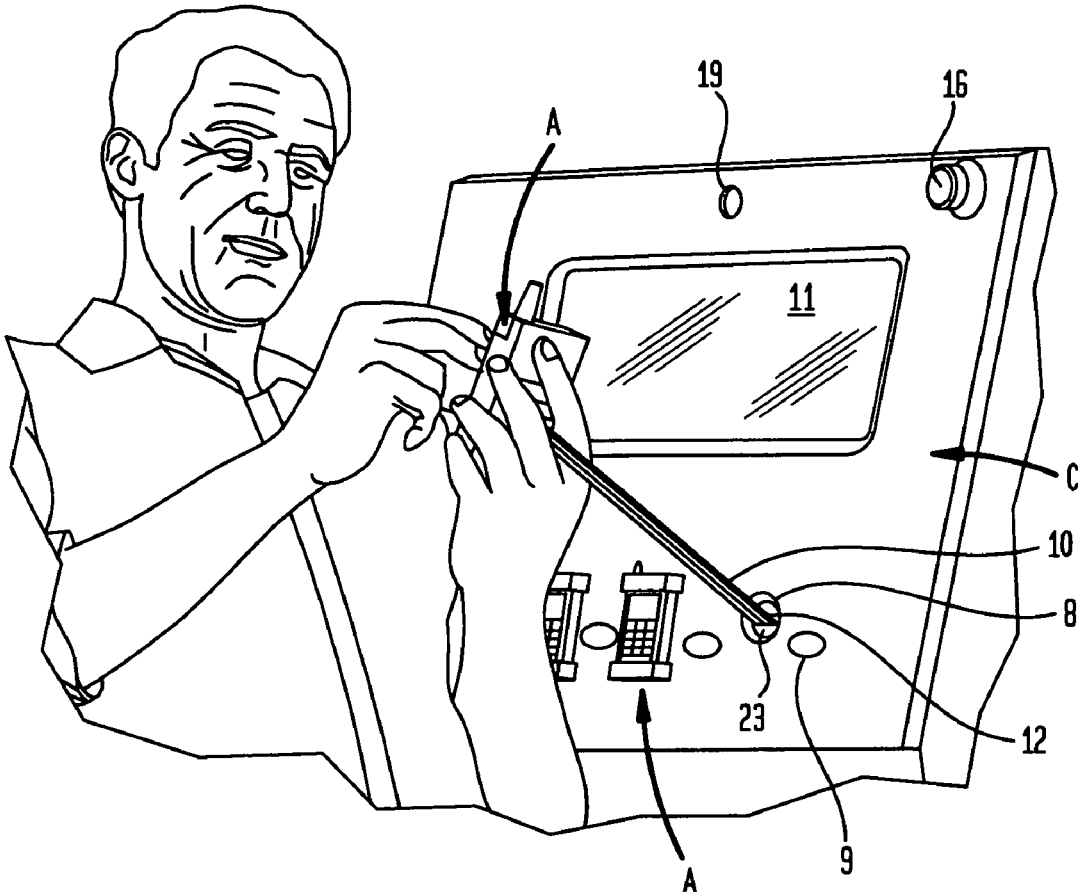
FIG. 1 is an environmental view depicting a man examining a battery operated, hand-held electronic device attached to the security apparatus of present invention.

As seen in FIG. 1, the present invention is a security device for the display of battery operated, hand-held electronic devices, generally designated A. Such devices include cell phones, calculators, digital cameras, hand-held computers, portable music playback and/or recording devices or the like.

The invention includes a three-part device engaging means, generally designated B, provided for each device A to be displayed. Devices A (three are shown) are separately mounted on a device support, generally designated C. Device support C supports and houses the apparatus components of the instant invention.

A tether 10 is provided for each displayed device A. Each device engaging means B is adapted to connect the displayed device A carried thereby to one end of the tether 10 associated with that displayed device. Each tether 10 consists of two electrically conductive metal cables, preferably steel cables, most preferably stainless steel cables. In an alternative configuration, each tether 10 may comprise a single, coaxial, shielded cable to provide a single sheathed one wire appearance. However, for clarity, only tethers with two visible metal cables are described and illustrated. It is to be understood that a tether with a coaxial cable will function in the same manner as a tether with the two separate conductive cables.

Each tether 10 extends through a separate opening in the surface of support C. Directly behind each opening is a female positioning component 23 with a uniquely shaped recess 12, best seen in FIGS. 3 and 4. The end of the tether that is not connected to the displayed device A is connected to an electronic recoiler device, generally designated D, located within support C, through opening 12 in component 23.

Figure 3:
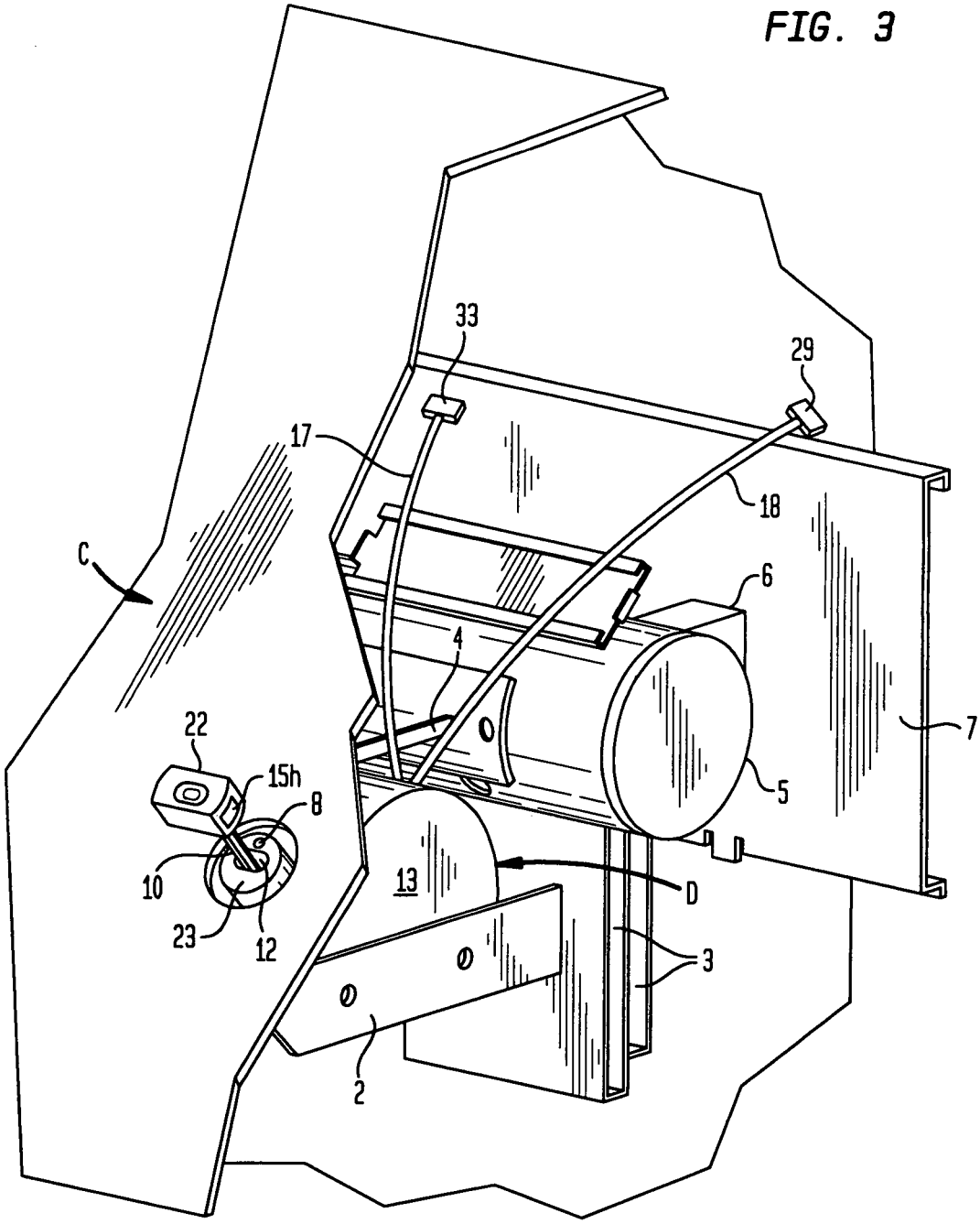
FIG. 3 is partial cut-a-way view of the support of the security display apparatus of the present invention, showing the disposition of the electronic recoiler device.

FIG. 3 shows the general arrangement and mounting of the electronic recoiler D behind the surface of support C. Numerals 2, 3, 4, 5, 6 and 7 denote components of support C that hold the mechanism of recoiler D and its housing 13 on the support. Housing 13 encloses the mechanism of the recoiler.

Cable 17 is an optional lead to an external alarm system that extends from motherboard 20, situated within recoiler housing 13. Cable 18 is a lead that extends from motherboard 20 to an external DC power supply means 30, which provides power to power management circuitry located on the motherboard. Tether 10 extends from recoiler D, passes through the surface of support C and through opening 12 in female positioning component 23 and enters tie-box 22, which forms part of the device engaging means B, through male positioning component 24 (shown in FIG. 4) where it connects to card edge connector 15*c* (see FIG. 2B). Component 24 has a shape that corresponds to the shape of opening 12 such that the tethered device A can only mount on support C in a single orientation.

Figure 4:
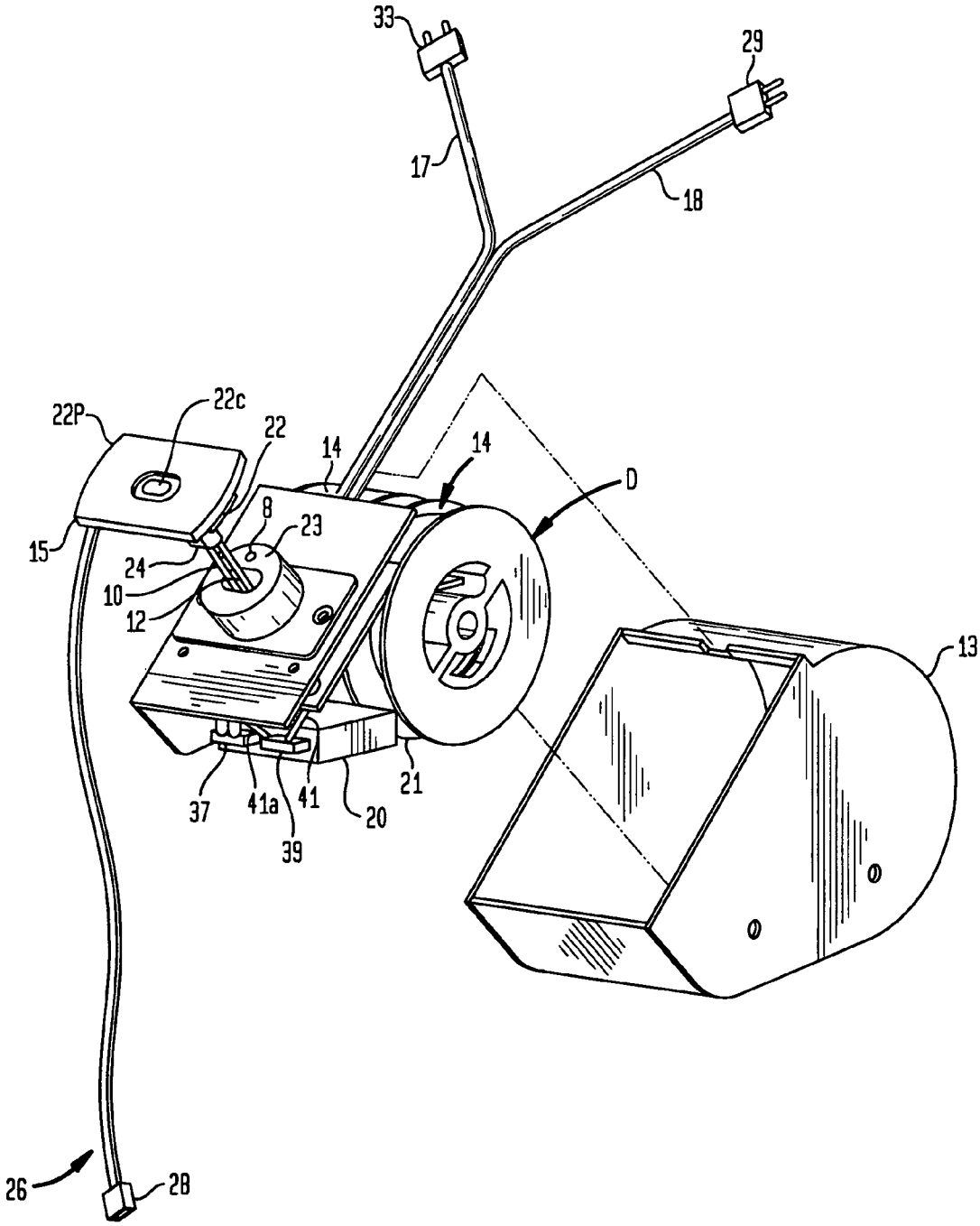
FIG. 4 is an isometric view of the recoiler exploded from its housing, showing electrical connections to the base of the device engaging means, as well as the electrical cords connecting the device to the alarm system and power source.

FIG. 4 illustrates the internal components of recoiler D. Each recoiler D includes a spring-loaded recoiler mechanism 14 and a printed circuit motherboard 20. The motherboard carries power management circuitry, power level sensing circuitry, alarm circuitry and audible alert or siren means, all of which are known in the art.

Lead 17, with connector 33 at the end thereof, feeds the output from motherboard 20 to an optional external alarm system. Lead 18, with connector 29 at the end thereof, preferably a keyed input connector to avoid tampering, extends from motherboard 20 to the external DC power supply.

Figure 5:
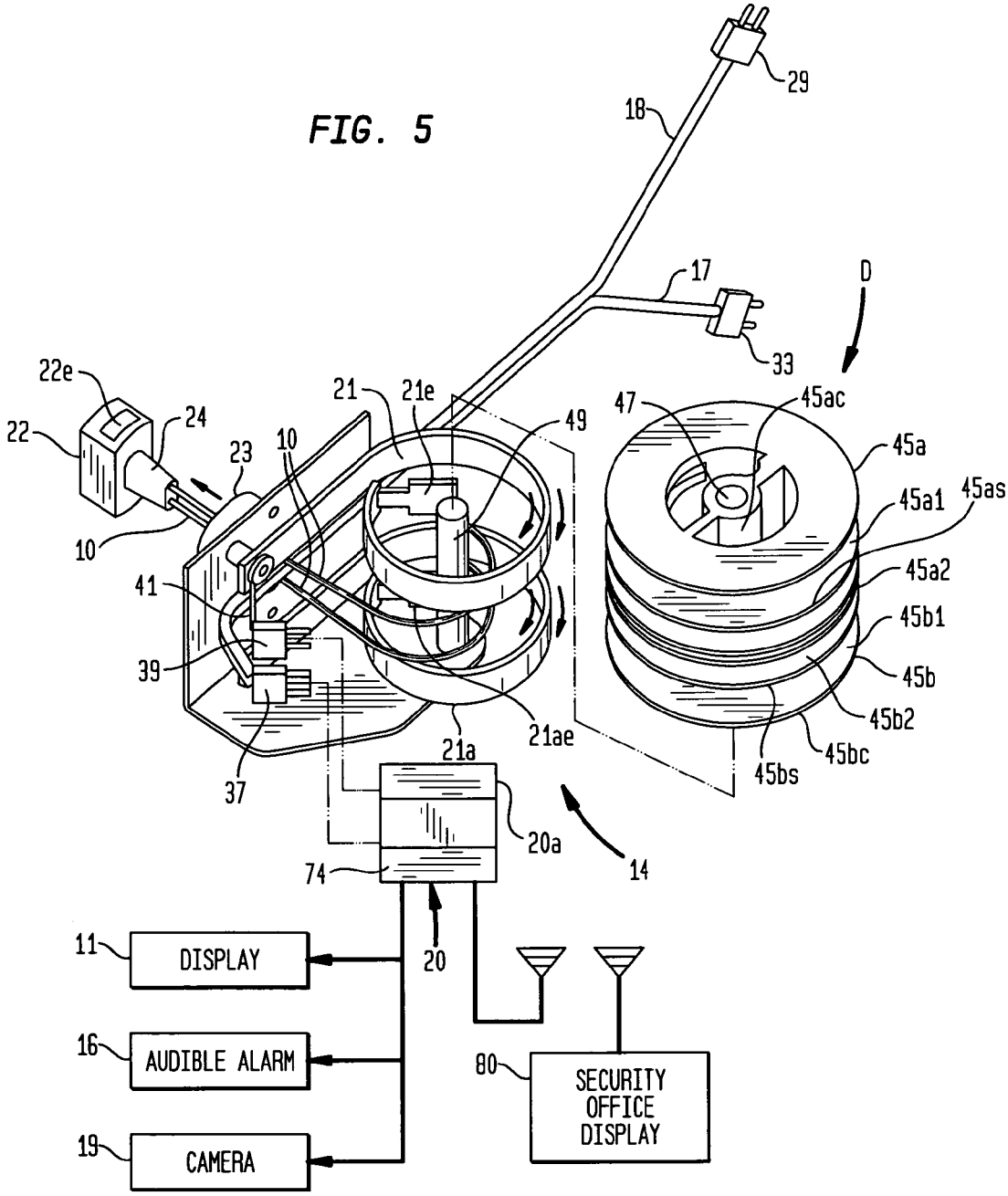
FIG. 5 is an exploded isometric view of the recoiler showing the spring-actuated retractor mechanism, daughter printed circuit board, electrical plugs connecting to the daughterboard, electrical connections to the retractor spring and tether mechanism, and electrical leads to a power source and an alarm system.

Connecting to motherboard 20 are pin connector 37 which brings power to the motherboard 20 and sends alarm signals out (see FIG. 5), and a pin connector 39 which transmits power from motherboard 20 to recoiler springs 21 and 21*a* (seen in FIG. 5) via wire connectors 41 and 41*a*. Also visible in FIG. 5 is the tie-box 22, having a tie-box cover 22*c* (seen in FIG. 4) which in turn is covered by a tie-box pad 22*p* to which the device engaging means B is attached.

Alarm and power cable 26 emanates from daughterboard 15 (see FIG. 2B) situated within tie-box 22. It carries a connector 28 which connects to the display device A. Tether 10 extends from opening 12 in female positioning component 23 into tie-box 22 via male positioning component 24. Also depicted in FIG. 4 is the off-hook optical sensor 8 located on component 23.

As illustrated in FIG. 1, the display system of the present invention permits a potential customer to approach a display having several devices A mounted thereon, select the device of interest and examine that device. The selected device, and the device engaging means B within which it is secured, can then be pulled away from the display support toward the customer, against the spring action of the spring-loaded recoiler mechanism 14 (FIG. 4).

The recoiler exerts a retracting force on the tether to which the displayed device is attached. The customer can hold and handle the selected device to get the feel of the device in his or her hand and examine the device closely to determine if he or she wishes to purchase the product. When the potential customer is finished examining the device, the recoiler will return the device back to it position on the display support, in the proper orientation.

While the customer is examining the device, the device cannot be removed from the device engaging means B. Further, it cannot be moved to a position too far away from the display because of tether 10. Thus, the customer can examine the device conveniently but cannot remove the device from the display apparatus without severing tether 10, or forcibly removing it from device engaging means B.

Figure 6:
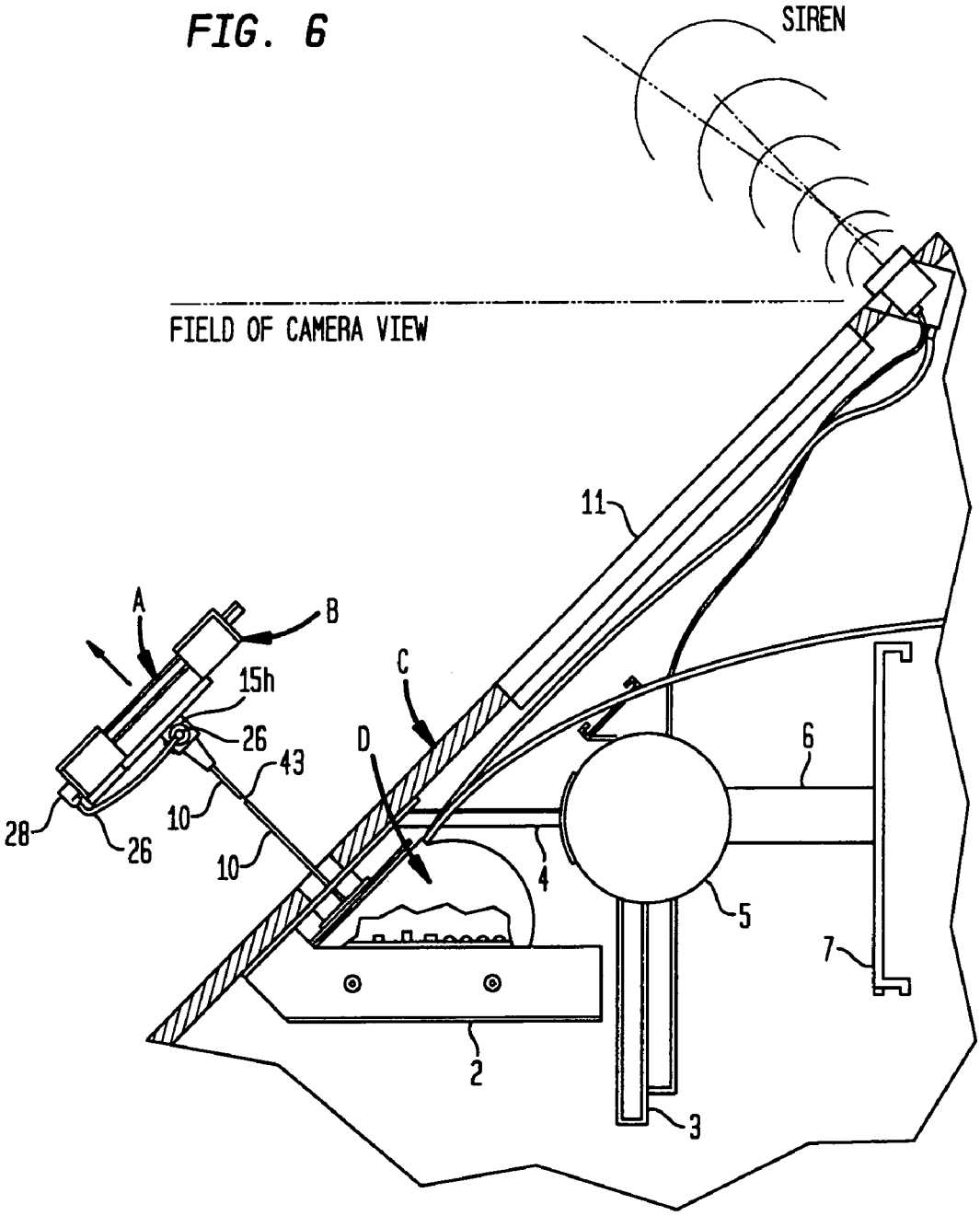
FIG. 6 is a side cross sectional view of the display apparatus depicting the actuation of alarm systems and security camera when the tethering means that connects to a hand-held device engaging means is severed or disconnected.

Should one or both of the strands of tether 10 be severed creating opening or disconnect 43 (FIG. 6) or should the power supply to device A be disrupted by unplugging device power plug 28 or forcibly removing device A from device engaging means B, an alarm condition will be detected by the power level sensing circuit 20*a* on motherboard 20. That will set off security measures, as depicted in FIG. 6. The nature of those security measures will depend on the requirements of the area in which the display apparatus of the present invention is situated. Those measures will include at least one or all of the following: an audible alarm 16 from the display itself, an external audible alarm from the alarm system of the display area, a radio frequency (RF) alarm signal transmitted to remotely located security personnel, a visual image of the perpetrator taken by a camera 19 mounted in the display apparatus (FIG. 1) transmitted by wire or RF signal to a security office where it is made visible on video display means 80 therein, and/or an alarm message displayed on video display means 11.

An additional safeguard against pilferage of devices A is placing an RFID or electronic article surveillance (EAS) tag within the displayed device and having sensors connected to an alarm system at the exits of the display area or store or both. Such RFID or EAS tags are commercially available. In the event other security measures fail, or have not elicited a response, a perpetrator will set off an alarm when passing through any of the aforesaid exits.

Motherboard 20 is typically situated within recoiler housing 13 and attached to the recoiler mechanism. However, motherboard 20 may instead be situated outside recoiler housing 13 or in a separate housing.

Figure 8:
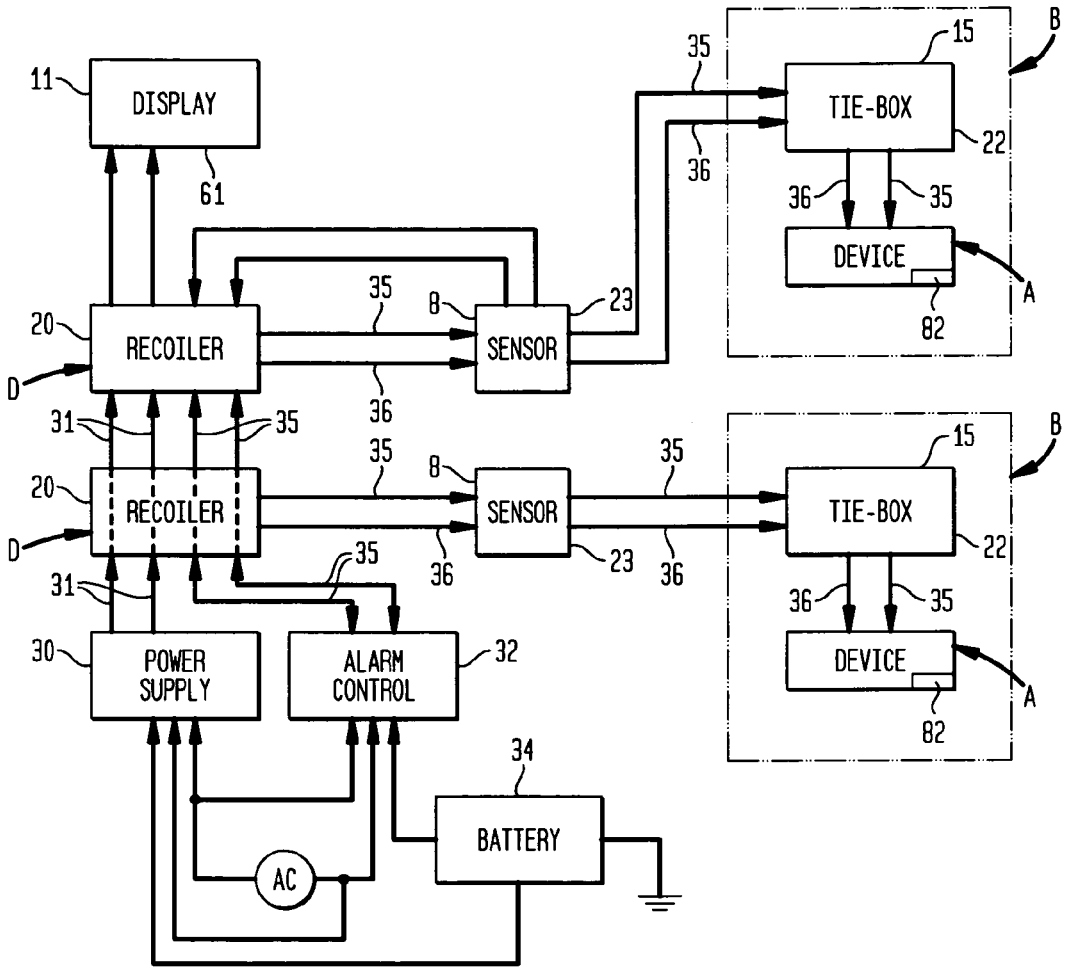
FIG. 8 is a block wiring diagram of the security display apparatus of the present invention.

Each recoiler of the display apparatus has an associated motherboard 20 that is supplied with DC power from an external power supply 30, as indicated in block wiring diagram, FIG. 8. Typically, the power supply delivers about 12 VDC to motherboard but voltages that fall within the range of about 6 VDC to about 12 VDC can be used. The external power supply is connected to the motherboard via a connecting plug 29, which is preferably a keyed and locking input connector.

Electronic circuitry on motherboard steps the DC voltage supplied by the external power supply down to lower pulsating DC voltages to power the displayed device connected thereto. Typically, for some types of electronic devices such as cell phones, an input voltage of about 12 VDC is converted to about 6 VDC at 1.4 A. However, a range of voltages may be provided according to the requirements of the specific device to be displayed.

In the event the polarity of the input voltage is reversed, each motherboard contains circuitry, as known in the art, that detects the polarity reversal and shuts recoiler down, thereby protecting it and displayed device A from damage. Such an event might occur if the poles of input connector 29 were reversed as a result of tampering.

Each motherboard can be connected to an external alarm system via lead 17 and connector 33. The power signal from external power supply 30 enters the motherboard via a connector 37, typically a pin connector. Connector 37 also provides connection for the alarm signal output to an external alarm via lead 17 and connector 33. Current fed to recoiler springs 21 and 21*a* exits the motherboard via connector 39, which is also typically a pin connector. Wires or other electrically conductive elements 41, 41*a* connect the power output of the motherboard to recoiler springs 21 and 21*a*.

Each motherboard also contains circuitry that delivers a light path to off-hook sensor 8, located on female positioning component 23, via a fiber-optic tube or a multiplicity of fiber-optic tubes. Each motherboard also has an impedance variance detection circuit that provides an alarm signal to an audible PNP transistor device. The alarm signal can activate an external alarm system, such as a display alarm, when that circuitry senses an alarm condition.

Each motherboard also carries an integrated alarm module and siren. The alarm module can be activated when circuitry on the motherboard senses an alarm condition, when interfacing with an existing external alarm system is not an option due to the absence of such an external alarm system, when cable management to interface with an existing external alarm system is difficult or when simple discrete alarming is required.

Each motherboard additionally has circuitry that controls wireless transmission of an alarm signal to a remote location via wireless transmission means. The wireless signal may be used to alert security personnel via visual or audible means as to the location and specific item that is being pilfered. Another circuit module on the motherboard is a video capture circuit that stores pixilated images from digital camera 19 mounted on the security display.

Each motherboard includes counting circuitry 74 that is advanced each time the associated device is removed from the display. For example, the counting circuitry 74 can count the occurrence of an event such as the lifting of any device A from the display support, record and store downloadable data in a processor relating to that event, such as the total occurrences of such events, and transmit that data via a USB port or other port means for display on means such as a video monitor or to activate an electromechanical readout counter, for analysis at a remote location.

Each motherboard also carries circuitry to deliver output power to daughterboard 15 located in tie-box 22 via electrically conductive recoiler mechanism springs 21 and 21*a*, and the electrically conductive two stranded tether 10 (or alternatively via two electrically separate wires within a single strand of coaxial cable). The combination of motherboard 20 and daughterboard 15, which comprises power management circuitry, deliver power to the displayed device at a level suitable to the requirements of that device.

Each motherboard has circuitry to control activation of peripheral devices such as LCD monitors and media players when signals are received from remote sensors. For example, each motherboard has optical sensing circuitry that receives signals from off-hook optical sensor 8, when a device A is lifted from device support C. That circuitry then transmits signals that actuate components such as media players and processors that provide digitized video and audio signals to video means display 11 and to audio speaker means 16, wherein product information is visibly displayed and made audible. Circuitry on the motherboard enables a user to select which information is displayed on video display 11, while locking out the display of unselected information.

A display activation button (or jog button) 9 is provided adjacent each device on support C. That button typically comprises a metallic disc that is electrically insulated from the support, when the support is an electrical conductor. The metallic disc is electrically connected to the input of a PNP transistor on the motherboard associated with the adjacent device, which acts as a switch when a person touches the disc, completing the circuit through ground. The output from the transistor activates a track selector on media player 61 or an equivalent connection on a processor, to display video on video display means 11 and produce audible sound on audio speaker means 16. Typically, video display functions and audio amplification and sound production are combined by use of a monitor. Repeated touching of the metallic disc of the display activation button (or jog button) 9, serves to "jog" the track selector on media player 61 causing a change in tracks, resulting in a change in the information displayed on video display means 11 and audibly produced on audio speaker means 16.

In a preferred embodiment of the display apparatus of the present invention, the media player 61 is a flash card media player wherein the information to be displayed and heard is contained on a flash media card. Track activation and selection is produced by a person touching display activation button (or jog button) 9 as described above.

Figure 7:
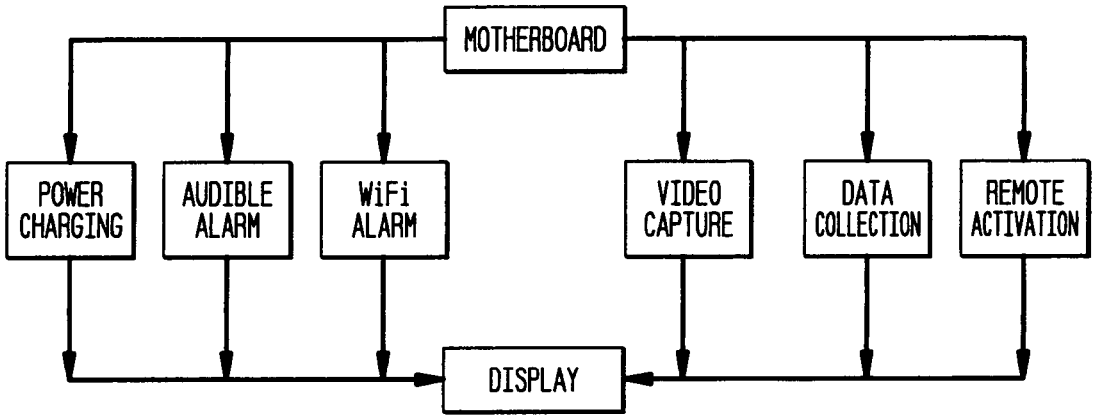
FIG. 7 is a block flow diagram depicting the functions of the motherboard which control the display device.

Additional circuitry and signal reception means on the motherboard enable the information displayed on video display means 11 and heard on audio speaker means 16 to be driven by wired or wireless broadband transmission or satellite transmission. The video and audio information to be conveyed by the display may be received by the media player from broadband or satellite transmission means. Media player 61 controlled by display activation button (or jog button) 9, determine the display, as described above. By use of broadband or satellite transmission means, the information conveyed by the display apparatus may be remotely transmitted and modified and conveniently updated. The functions of motherboard 20 are illustrated in FIG. 7.

Each daughterboard 15, situated in a tie-box 22, is a printed circuit (PC) board containing circuitry that provides the logic for device power management. The circuitry supplies the correct voltage and regulates the current delivered to the device A attached thereto. The device power management circuitry on the daughterboard can step down from the voltage delivered to it from the motherboard to accommodate the power needs of the particular device A being displayed.

The daughterboard also contains circuitry that provides the logic for the security of device A. The circuitry includes sensing circuitry that monitors the power level from the daughterboard to device A to detect variances or disruptions, such as loss of power, a dead short, a short to ground, an open circuit, and the like. In the event the "electronic fingerprint" of device A in its normal display condition is altered, the daughterboard delivers an "alarm condition" signal to the associated motherboard.

The daughterboard delivers power to device A via power delivery cable 26 directly connected between the daughterboard (FIGS. 2, 4) and a device specific power plug 28, which fits into the power port of device A. Since current is always delivered to the battery of device A, whether or not device A is in use, the device battery 82 is always kept at its maximum charge state. Therefore, the customer will always examine a fully charged product.

Figure 2:
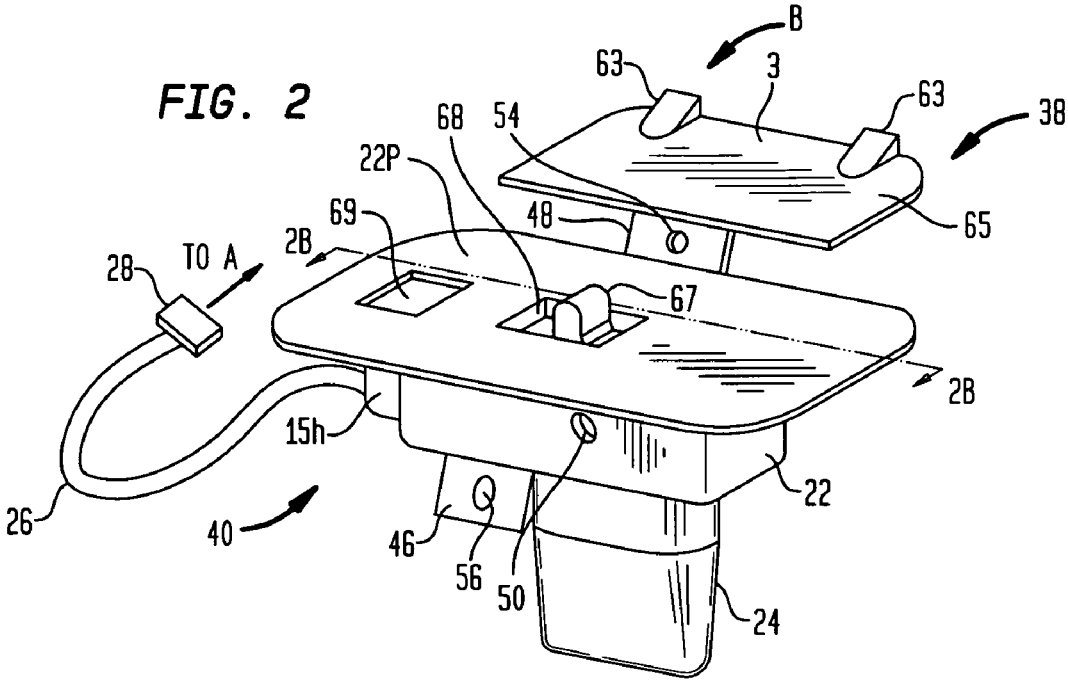
FIG. 2 is an isometric view of the device engaging means of the present invention.

To facilitate replacing any device A displayed on the display apparatus of the present invention with a new device A, having different power requirements, which is frequently the case, the daughterboard, with its attached power delivery cable may be produced as a disposable or exchangeable unit that plugs directly into a card edge connector situated in the tie-box, or is placed in housing **15*h* which fits into tie-box 22 and then plugs into card edge connector 15*c*, as in the version depicted in FIG. 2**B. In this manner, the daughterboard can be easily and conveniently exchanged for another daughterboard having power management circuitry that meets the power requirements of the new device A, when a new device A is mounted on the display.

FIG. 8 is a block diagram illustrating the power and alarm circuitry arrangement of the security display apparatus of the present invention. It can be seen that an AC power source supplies power to the main power supply 30 and (optionally) to an external central alarm control circuit 32. The main power supply 30 simultaneously feeds DC power (designated 31) to each electronic recoiler device D. Each recoiler is associated with a motherboard 20 which under the appropriate conditions transmits an alarm signal (designated 35) and a power signal (designated 36) through the female positioning device 23 to the daughterboard contained in the tie-box 22 which forms part of the associated device engaging means B.

The daughterboard 15 transmits the alarm signal 35 and the power signal 36, having the appropriate power level for device A, to device A via hard connections. The motherboard 20 also transmits alarm signal 35 to optional external central alarm control 32, as well as an alarm module contained on the motherboard 20. A battery backup 34 supplies DC power to the electronic recoiler devices D and the external central alarm control 32 in case of power failure.

As any device A is lifted from device support C, off-hook sensor means 8 detects same and transmits a signal via motherboard 20 (FIG. 4) which activates video display means 11. Sensor 8 is preferably an optical detector, such as an infrared detector, a photo cell detector, a proximity detector or a fiber optic sensor, all of which are known in the art. Most preferably, sensor 8 is a fiber optic sensor. Video display means 11 can be any a conventional cathode ray tube (CRT) display screen, plasma display screen or LCD display screen. Preferably an LCD display screen is utilized.

The video display shows the potential customer video, printed or graphic information promoting the features of the specific device A that the potential customer lifted from the display support. Sound associated with the video display is provided to the potential customer via at least one audio speaker 16, which is driven by a differential amplifier attached to motherboard 20 (FIG. 4) or the monitor's internal circuitry.

To compare product information about the selected device A in hand with any other device on the display, the potential customer touches display activation means button 9 (also known as a "jog" button) situated on support C adjacent to the selected device. That causes a signal to be transmitted via motherboard 20 (FIG. 4) that first selects the appropriate menu item by jogging down the on screen list, then activates display of a specification comparison chart on video display means 11 via media player or media processor means. The display activation means may be selected from a membrane switch, capacitance switch or touch screen. By touching display activation button 9 again, the potential customer can select other stored information related to the selected device from a menu displayed on video display means 11.

As mentioned previously, the display device of the present invention provides means to continuously recharge the battery of each of the displayed hand-held electronic devices A while simultaneously providing alarm means to prevent or signal pilferage of displayed devices. This is accomplished by providing a continuous trickle charge circuit on each motherboard. The trickle charge from the motherboard 20 is sent through recoiler mechanism springs 21 and 21*a* (FIGS. 4, 5) and tether 10 (FIGS. 1-6) to device A. Each of those components functions simultaneously as an electrical conductor, a component of the alarm system and as a physical restraint to pilferage.

Tether 10 exits device support C via female positioning component 23 and enters male positioning component 24 (see U.S. Pat. No. 6,659,382) which forms part of tie-box 22 (FIG. 2). The tie-box is a component of device engaging means B. The two electrically conducting cables which comprise tether 10 terminate in tie-box 22 where they electrically connect to daughterboard 15 via card edge connector 15*c* (FIG. 2B) contained therein. Each cable acts as a single electrically conducting wire. For each recoiler, the same two wires of the tether preferably carry both current to charge the associated displayed device A and alarm signals to motherboard 20, should the connection to device A be disrupted.

Figure 2A:
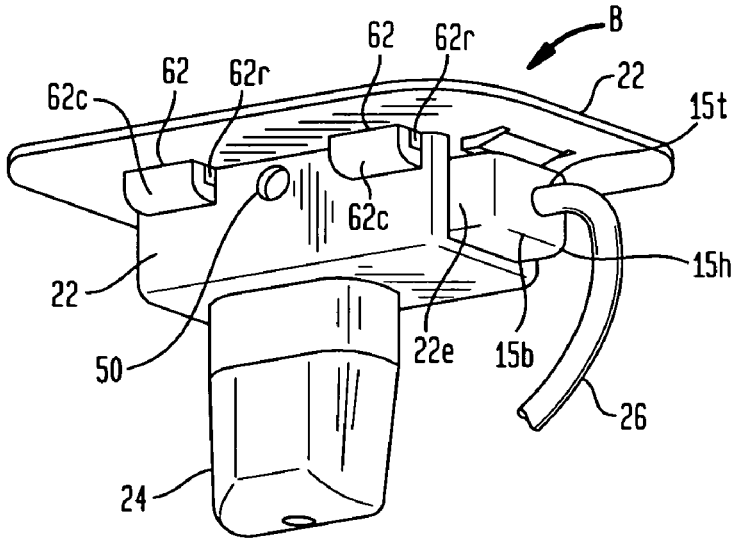
FIG. 2A is an isometric view showing the tie-box assembly of the present invention.
Figure 2B:
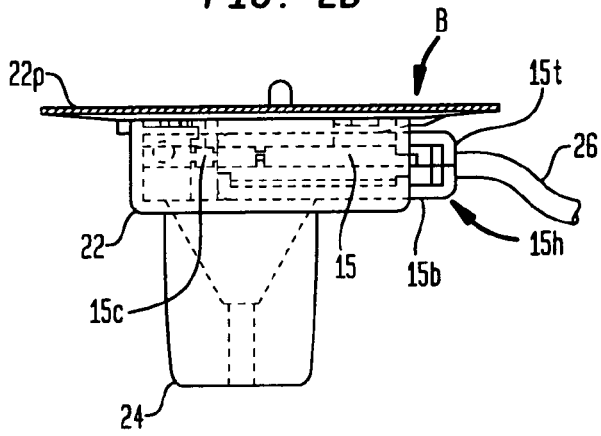
FIG. 2B is a cross-sectional view along line 2B-2B of FIG. 2 showing the daughterboard within the daughterboard support plugged into the tie-box card edge connector.
Figure 2C:
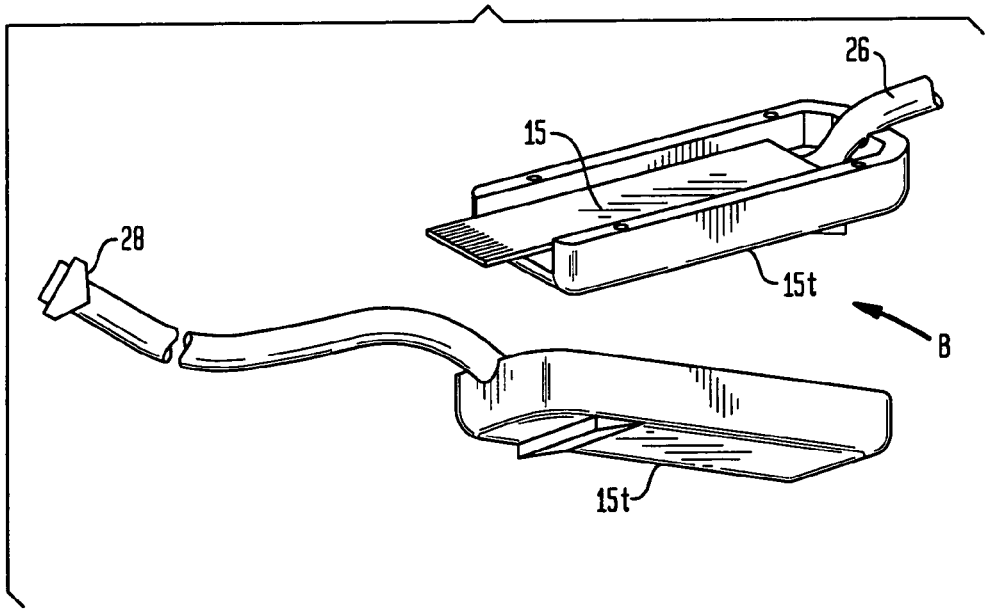
FIG. 2C is a view of the interior and the exterior of the top part of a daughterboard housing containing a daughterboard.
Figure 2D:
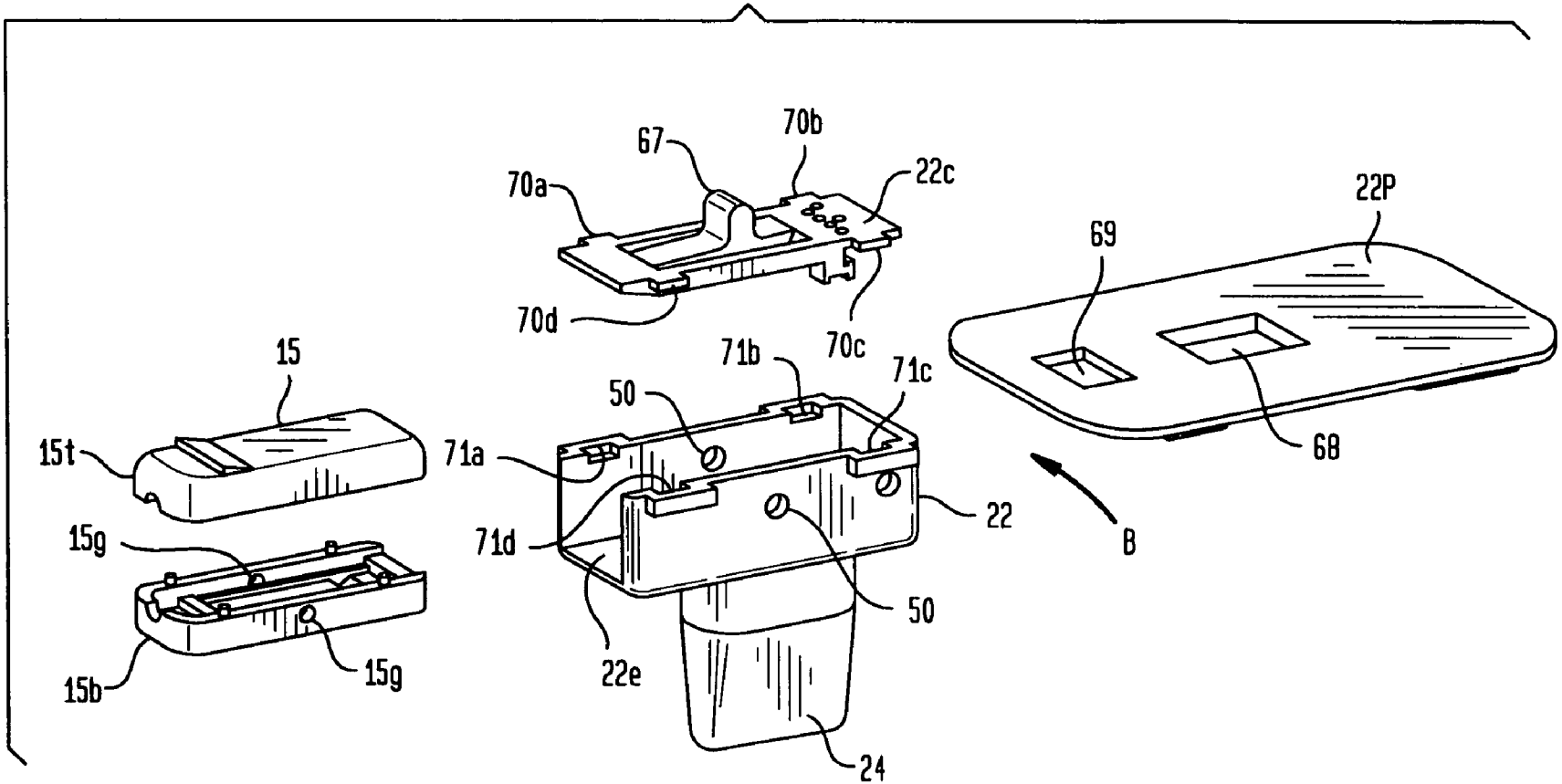
FIG. 2D is an exploded view of the top and bottom of the daughterboard housing, the tie-box, tie-box cover and tie-box pad.
Figure 2E:
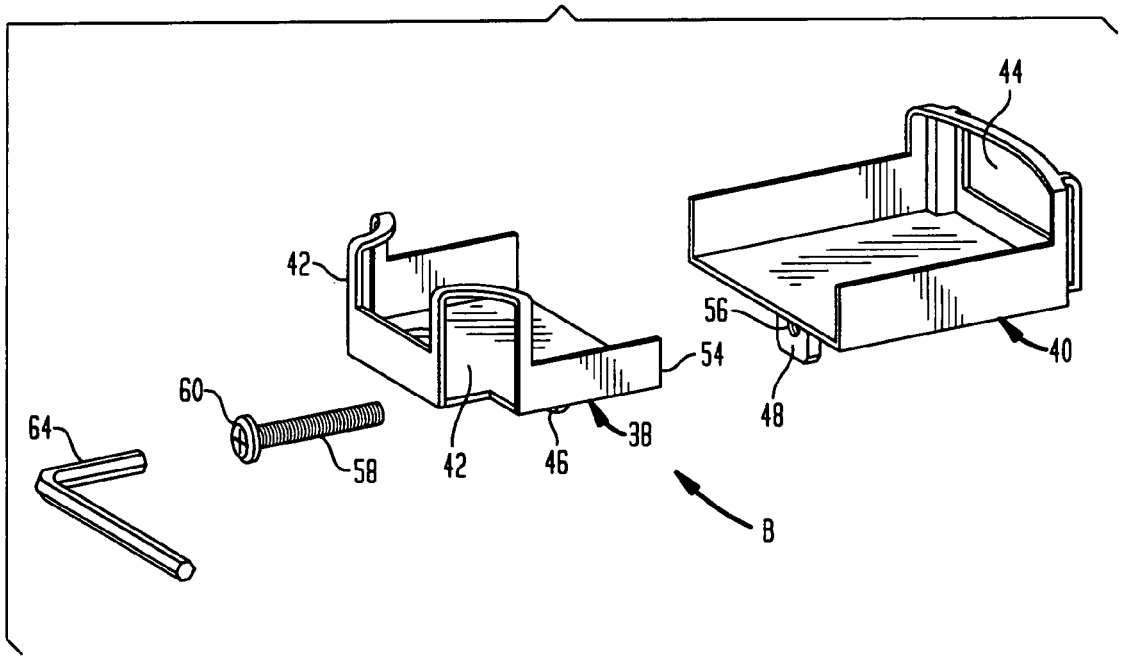
FIG. 2E is an exploded perspective view of the upper and lower sections of the clamping means used in conjunction with the tie-box assembly.

Referring now to FIG. 2 through 2E, device engaging means B includes three main components: (i) a clamping means comprising a hollow top section 38, and a hollow bottom section 40 which receive and retain the device A to be displayed, (ii) a hollow tie-box 22 containing card edge connector 15*c* (FIG. 2B) to connect with daughterboard 15, contained in daughterboard housing 15*h*, which comprises daughterboard housing top 15*t* and daughterboard housing bottom 15*b* (FIG. 2-FIG. 2D), and (iii) positioning component 24 attached to tie-box 22. Although daughterboard housing 15*h* provides convenience in handling daughter board 15 which is electrically connected to cable 26, in some embodiments of the invention that housing can be omitted, with daughterboard 15 situated directly in tie-box 22.

Tie-box 22 also comprises tie-box cover 22*c* with optional flexible plastic tab 67 which protrudes through opening 68 in tie-box pad 22*p* (FIGS. 2, 2B, 2D). Optional flexible plastic tab 67 has a metallic strip on its underside (not shown) which is depressed when device A is placed in device engaging means B, and locked onto tie-box 22. That closes an optional alarm circuit by making contact with optional electrical contacts (not shown) extending from daughterboard 15, through the top of daughterboard housing 15*t* (FIG. 2D). The foregoing arrangement adds a further degree of protection to device A by tripping an alarm should an attempt be made to remove daughterboard housing 15*h*, device engaging means B, or tie-box pad 22*p*.

Another security feature may be provided by optional flexible plastic transverse spine 15*s* on daughterboard housing top 15*t* which snaps into optional opening 69 in tie-box pad 22*p* thereby locking daughterboard housing 15*h* in place within tie-box 22 (FIGS. 2A, 2C, 2D). A flat edged tool may be used to depress spine 15*s* when removing housing 15*h* from tie-box 22. As will be evident to those skilled in the art, tie-box cove 22*c* may be readily manufactured without flexible tab 67, openings 68 and 69 on tie-box pad 22*p* may be omitted and spine 15*s* on housing top 15*t* may be omitted as required.

In the version of tie-box 22 illustrated in FIG. 2D tie-box cover 22*c* snaps down into tie-box 22 and is held on place by male snap fittings 70*a,b,c,d* and female snap fittings 71*a,b,c,d*. With tie-box cover 22*c* in place on tie-box 22, daughterboard housing 15*h* containing daughterboard 15 can be inserted into tie-box 22 via tie-box entrance 22*e* (FIGS. 2A, 2D) Tie-box 22 also comprises tie-box pad 22*p*, which fits on top of tie-box cover 22*c* and also fits between top part 38 and bottom part 40 of the clamping means. Tie-box pad 22*p* is firmly connected to tie-box 22 by any convenient connecting means known in the art, preferably reversible connection means, to facilitate assembly and disassembly. That connecting means may comprises a "slide on" means 62 illustrated in FIG. 2A (two seen, two at back not seen) wherein rails 62*r* integral to tie-box 22 are engaged by couplings 62*c* integral to tie-box pad 22*p*.

Tie-box 22 and daughterboard housing 15*h* are preferably formed from plastic materials due to their relatively low cost, most preferably ABS, due to its durability and ease of handling, and may be conveniently formed by a variety of processes known in the art such as injection molding, machining or thermoforming where applicable. Sections 38 and 40 of the clamping means may be formed from any commonly used metal or alternatively from plastic or polymeric materials by conventional processes providing that the clamping means so produced, when used as a component of device engaging means B, has sufficient strength to securely retain device A.

Depending on the dimensions of device A, top section 38 and bottom section 40 of the clamping means may be adjusted to tightly fit and securely retain device A or may be custom made to tightly fit around and securely retain device A when used in conjunction with tie-box 22. In the version of the clamping means illustrated in FIG. 2, brackets 63 are arranged on top section 38 and bottom section 40 to receive a small electronic device A, such as a cell phone.

As illustrated in FIG. 2, sections 38 and 40 of the clamping device are placed on top of tie-box pad 22*p* so that top plate 65 and bottom plate 66 are in contact with tie-box pad 22*p* and are aligned so that threaded hole 54 in tab 48 and threaded hole 56 in tab 46 line up with through security hole 50 in tie-box 22 (FIGS. 2 and 2A) so that security screw 58 (FIG. 2E) can be inserted and tightened thereby attaching top section 38 and bottom section 40 to tie-box 22 and clamping device A to tie-box 22.

In versions of the instant invention wherein daughterboard 15 is contained in daughterboard housing 15*h*, through security hole 50 may also be extended to pass through the walls of daughterboard housing 15*h*, generally by providing holes 15*g* (FIG. 2D) in the walls of bottom section 15*b* that line up with through hole 50 of tie-box 22 when daughterboard 15 is engaged by card edge connector 15*c*.

Another version of the clamping means to be used in conjunction with tie-box 22 is illustrated in FIG. 2E wherein the same numbers are used to describe parts analogous to those in FIG. 2. As seen in FIG. 2E, upper section 38 of the clamping means is provided with opening 42 designed to accommodate an antenna on device A, and lower section 40 is provided with opening 44 which provides access for device power plug 28 (FIG. 2) to a power input port for the particular device to be displayed. As with the version of the clamping means illustrated in FIG. 2, in the version illustrated in FIG. 2E, top section 38 and bottom section 40 each have a securely attached tab 46 and 48 located along the central longitudinal axis of their underside and protruding at right angles therefrom. Tab 46 has centrally located threaded opening 54 (not seen), and tab 48 has centrally located threaded opening 56, with said openings disposed so that opening 54 of tab 46 aligns with through opening 50 of tie-box 22 (FIG. 2) and opening 56 of tab 48 aligns with the other end (not seen) of through opening 50 of tie-box 22 (FIG. 2) so that a screw 58 (FIG. 2E) may be inserted into opening 54 of tab 46 and screwed in so that it passes through the through opening 50 of tie-box 22 from which it emerges and screws into opening 56 of tab 48 and locks a device A, contained within the hollow of top section 38 and the hollow of bottom section 40 within device engaging means B formed by top section 38, tie-box 22 with tie-box pad 22*p* and bottom section 40. Device A is securely retained in between the sections and cannot be removed from device engaging means B when sections 38 and 40 are secured to the tie-box.

For extra security, a screw 58 having a special screw head 60 (FIG. 2E) requiring a special screw driver or key 64 (FIG. 2E) to rotate the screw can be used to secure the top and bottom sections of engaging means B to the tie-box. Tie-box 22, which also contains male positioning component 24, may be formed from any commercially available workable material such as metals and polymers but is preferably formed from polymeric materials, most preferably ABS plastics due to ease of processing, durability and economy, by molding from commercially available plastic or polymeric formulations or by other methods known in the art or by machining.

Referring now to FIGS. 2, 2A and 2B, it is seen that male positioning component 24 projects from the underside of tie-box 22. Male positioning component 24 has a particular cross sectional shape (ovoid as illustrated) that corresponds to the shape of opening 12 of female positioning component 23 on device support C. Male positioning component 24 can be received by female positioning component 23 in only one orientation, thereby setting the orientation of device A relative to the support. This feature can be further refined, as explained in the herein incorporated U.S. Pat. No. 6,659,382, through the use of additional correspondingly shaped interlocking features, such as ribs and a rib-receiving channel, permitting the device to be received on the support in only a single orientation.

Tether 10 emerges from male positioning component 24 and extends through opening 12 in female positioning component 23 to the rear of device support C. As best seen in FIG. 5, which is an exploded view of electronic recoiler device D, the two strands of tether 10 that emerge from the backside support C are kept from making electrical contact with each other in order to avoid a short circuit resulting in a false alarm. Each of the two strands of tether 10 is wound onto a separate spool 45*a* and 45*b*. Spools 45*a* and 45*b* are electrically insulated from each other. Each spool has a separator 45*as* and 45*bs* that separates the spool into two sections 45*a*1, 45*a*2 and 45*b*1, 45*b*2 respectively. Spool section 45*a*2 of spool 45*a* receives one strand of two stranded tether 10. Spool section 45*b*2 receives the second strand of two stranded tether 10.

Coiled spring 21 is wound around section 45*a*1 of spool 45*a*. Coiled spring 21*a* is wound around spool section 45*b*2 of spool 45*b*. The ends 21*e* and 21*ae* of coil springs 21 and 21*a* are attached to the respective cores 45*ac* and 45*bc* of spools 45*a* and 45*b* on which they are wound. Coil spring 21 wound on section 45*a*1 of spool 45*a* is electrically connected to the strand of tether 10 wound on section 45*a*2 of spool 45*a*. Coil spring 21*a* wound on section 45*b*1 of spool 45*b* is electrically connected to the second strand of tether 10 wound on section 45*b*2 of spool 45. Coil spring 21, and the strand of tether 10 to which it is electrically connected, are electrically insulated from coil spring 21*a*, which is electrically connected to the second strand of tether 10.

As shown in FIG. 5, both spools 45*a* and 45*b* have a central opening 47 to receive an axle 49 around which spools 45*a* and 45*b* rotate. As will be evident to one skilled in the art, a similar arrangement to that described above may be achieved with two pairs of single sectioned spools, wherein each pair of spools is attached in a side-by-side arrangement and the two pairs of single sectioned spools are combined to form an arrangement similar to that depicted in FIG. 5.

In an alternative configuration, the spring loaded recoiler mechanism 14 may be used in conjunction with a tether 10 that is a single coaxial cable containing two electrically conductive strands. In that case, three spools may be employed, wherein the coaxial cable is received by a central spool flanked by two spools on which coil springs are wound in the manner described above. One of the two electrically conductive strands is electrically connected to one of the coil springs and the second of the two electrically conductive strands is connected to the second of the two coil springs.

The customer, when he or she removes the displayed device A from device support means C, as indicated in FIG. 1 causes spools 45*a* and 45*b* to rotate in a manner which tightens coil springs 21 and 21*a* on spools 45*a* and 45*b* thereby generating a retracting force which opposes the lifting of device A from device support C and causes device A to be returned to device support C when released by the customer.

It will now be appreciated that the present invention is an improvement of the security device for the display of hand-held items of the type disclosed in U.S. Pat. No. 6,659,382. As is evident from the above description, the electronic recoiler device of the security display apparatus of the present invention combines the function of tethering the displayed devices while at the same time supplying power required by the displayed devices by means of a continuous electrical connection from a power supply to the displayed device while providing wire and wireless alarm functions, as well as visual perpetrator identification and specific product information, and providing product comparisons to the potential customer by visual and audible means.

While only a limited number of preferred embodiments of the present invention have been disclosed for purposes of illustration, it is obvious that many modifications and variations could be made thereto. It is intended to cover all of those modifications and variations which fall within the scope of the present invention, as defined by the following claims.

We claim:

1. Display apparatus for a battery operated, hand-held, electronic device comprising a support, means for engaging the device, a spring-loaded recoiler situated in said support, a tether having one end attached to said device engaging means and a second end attached to said recoiler, said recoiler normally causing said tether to urge the device towards a given position relative to said support, an alarm, means for sensing the cutting of said tether and for energizing said alarm in response thereto, video display means and means for actuating said video display means in response to the movement of the device away from said given position.

2. The apparatus of claim 1 further comprising a flash media player associated with said video display means.

3. The apparatus of claim 1 further comprising speaker means associated with said video display means.

4. The apparatus of claim 1 further comprising indicator means, said indicator means being operably connected to said sensing means and energized thereby in response to the cutting of said tether.

5. The apparatus of claim 1 further comprising a second device, a second device engaging means, a second spring-loaded recoiler and a second tether having one end attached to said second device engaging means and a second end attached to said second recoiler.

6. The apparatus of claim 5 wherein said sensing means senses the cutting of one or both of said tethers.

7. The apparatus of claim 1 further comprising wireless signaling means actuated by said sensing means for sending a signal to a remote location indicating the cutting of said tether.

8. The apparatus of claim 1 further comprising means for selecting a message for display on said display means.

9. The apparatus of claim 1 further comprising means for charging the battery of the device.

10. Display apparatus for first and second hand-held, battery-operated electronic devices, said apparatus comprising a support, means associated with each of said devices for engaging the device, a spring-loaded recoiler situated in said support associated with each device engaging means, a tether associated with each of said devices having one end attached to said device engaging means for the associated device and a second end attached to said recoiler associated with said associated device engaging means, said recoiler normally causing said tether to urge the device towards a given position relative to said support, said apparatus further comprising an alarm, means for sensing the cutting of one of said tethers and for energizing said alarm in response thereto, display means and means for actuating said display means to display a message associated with one of the devices in response to the movement of that device away from said given position.

11. The apparatus of claim 10 further comprising a flash media player associated with said display means.

12. The apparatus of claim 10 further comprising speaker means associated with said display means.

13. The apparatus of claim 10 further comprising indicator means, said indicator means being operably connected to said sensing means and energized thereby in response to the cutting of one of said tethers.

14. The apparatus of claim 10 further comprising counter means associated with the tether attached to each device, and means for actuating each of said counter means in response to the movement of the device attached to the tether associated with that counter means.

15. The apparatus of claim 10 further comprising wireless signaling means actuated by said sensing means for sending a signal to a remote location indicating the cutting of one of said tethers.

16. The apparatus of claim 10 further comprising means for selecting a message for display on said display means.

17. The apparatus of claim 16 wherein a different message is associated with each device.

18. The apparatus of claim 10 further comprising means for charging the battery of one of the devices.

19. Display apparatus for a battery operated, hand-held, electronic device comprising a support, means for engaging the device, a spring-loaded recoiler situated in said support, a tether having one end attached to said device engaging means and a second end attached to said recoiler, said recoiler normally causing said tether to urge the device towards a given position relative to said support, a camera, means for sensing the cutting of said tether and for actuating said camera in response thereto, display means and means for actuating said display means in response to the movement of the device away from said given position.

20. The apparatus of claim 19 further comprising audible alarm means operably connected to said means for sensing the cutting of said tether and for actuating said audible alarm means in response to sensing the cutting of said tether.

21. The apparatus of claim 19 further comprising a second device, a second device engaging means, a second spring-loaded recoiler, a second tether having one end attached to said second device engaging means and a second end attached to said second recoiler, said second recoiler normally causing said second tether to urge the second device towards a given position relative to said support.

22. The apparatus of claim 21 wherein said sensing means senses the cutting of one or both of said tethers.

23. The apparatus of claim 21 wherein said means for actuating said display means further comprises means for actuating said display means in response to the movement of the second device from said given position.

24. The apparatus of claim 19 further comprising wireless signaling means actuated by said sensing means for sending a signal to a remote location indicating the cutting of said tether.

25. The apparatus of claim 19 further comprising means for selecting a message for display on said display means.

26. The apparatus of claim 19 further comprising means for charging the battery of the device.

27. The apparatus of claim 19 further comprising counter means and means for actuating said counter means in response to the movement of the device from the given position.

28. Display apparatus for a battery operated, hand-held, electronic device comprising a support, means for engaging the device, a spring-loaded recoiler situated in said support, a tether having one end attached to said device engaging means and a second end attached to said recoiler, said recoiler normally causing said tether to urge the device towards a given position relative to said support, counter means and means for actuating said counter means in response to the movement of the device away from said given position.

29. The apparatus of claim 28 further comprising an alarm and means for sensing the cutting of said tether and energizing said alarm in response thereto.

30. The apparatus of claim 29 further comprising indicator means, said indicator means being operably connected to said sensing means and energized thereby in response to the cutting of said tether.

31. The apparatus of claim 29 wherein said sensing means senses the cutting of said tethers.

32. The apparatus of claim 29 further comprising wireless signaling means actuated by said sensing means for sending a signal to a remote location indicating the cutting of said tether.

33. The apparatus of claim 28 further comprising display means and means for actuating said display means in response to the movement of the device away from said given position.

34. The apparatus of claim 33 further comprising a flash media player associated with said display means.

35. The apparatus of claim 33 further comprising speaker means associated with said display means.

36. The apparatus of claim 33 further comprising means for selecting a message for display on said display means.

37. The apparatus of claim 28 further comprising a second device, a second device engaging means, a second spring-loaded recoiler and a second tether having one end attached to said second device engaging means and a second end attached to said second recoiler.

38. Display apparatus for a battery operated, hand-held, electronic device, the device being powered by at least one battery, said apparatus comprising a support, means for engaging the device, means for providing power to maintain the at least one battery of the device in a charged condition, power level sensing means for detecting a change in the level of power provided by said power providing means and alarm signal transmission means responsive to said power level sensing means for generating an alarm signal when a change in the power level is sensed.

39. The apparatus of claim 38 further comprising a spring-loaded recoiler comprising two separate electrically conductive springs, a tether having two electrically conductive strands, one end of said tether being attached to said device engaging means with the electrically conductive strands of the tether electrically connected to said power level sensing means and a second end attached to said recoiler, with each electrically conductive strand connected to a separate one of said electrically conductive springs of said recoiler.

40. The apparatus of claim 39 wherein said power level sensing means senses the cutting of at least one of the electrically conductive strands of said tether and generates an alarm signal in response thereto.

41. The apparatus of claim 39 wherein said power providing means normally provides DC power having appropriate polarity to the device and wherein said DC power is transmitted through the springs of the recoiler and through the electrically conductive strands of the tether to the device.

42. The apparatus of claim 41 further comprising means for preventing transmission of DC power of inappropriate polarity to the recoiler.

43. The apparatus of claim 39 further including indicator means, said indicator means being operably connected to said power level sensing means and being activated thereby in response to the cutting of at least one of the electrically conductive strands of the tether.

44. The apparatus of claim 39 further comprising counter means associated with said recoiler and means for actuating said counter means in response to the movement of the device attached to the tether associated with said recoiler.

45. The apparatus of claim 39 further comprising wireless signaling means actuated by said power level sensing means for sending a signal to a remote location indicating the cutting of at least one of the electrically conductive strands of the tether.

46. The apparatus of claim 39 further comprising camera means and means for actuating said camera means and for transmitting a pixilated image from said camera means to a remote monitor, in response to said power level sensing means sensing the cutting of at least one of the electrically conductive strands of the tether.

47. The apparatus of claim 38 further comprising display means and means for actuating said display means in response to the movement of the device relative to the support.

48. The apparatus of claim 38 further comprising display means for displaying information relating to the device and a flash media player associated with said display means.

49. The apparatus of claim 48 further comprising speaker means associated with said display means.

50. The apparatus of claim 38 further comprising display means and means for selecting a message for display on said display means.

51. The apparatus of claim 50 for use with a second battery operated, hand-held, electronic device wherein a different message is associated with each device.

* * * * *